US008956796B2

(12) United States Patent
Kadokura et al.

(10) Patent No.: US 8,956,796 B2
(45) **Date of Patent: *Feb. 17, 2015**

(54) ELECTROSTATIC CHARGE IMAGE DEVELOPING TONER, ELECTROSTATIC CHARGE IMAGE DEVELOPER, TONER CARTRIDGE, DEVELOPING DEVICE, IMAGE FORMING APPARATUS, AND IMAGE FORMING METHOD

(71) Applicant: Fuji Xerox Co., Ltd., Tokyo (JP)

(72) Inventors: Yasuo Kadokura, Kanagawa (JP); Kazufumi Tomita, Kanagawa (JP); Hideaki Yoshikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/889,589

(22) Filed: May 8, 2013

(65) Prior Publication Data

US 2014/0170550 A1 Jun. 19, 2014

(30) Foreign Application Priority Data

Dec. 17, 2012 (JP) ..... 2012-274788

(51) Int. Cl.

| | |
|---|---|
| ***G03G 9/097*** | (2006.01) |
| ***G03G 9/093*** | (2006.01) |
| *G03G 15/08* | (2006.01) |

(52) U.S. Cl.

CPC ..... *G03G 9/09342* (2013.01); *G03G 15/0865* (2013.01)

USPC ..... 430/109.1; 430/108.6; 430/108.7; 430/123.51; 399/222

(58) Field of Classification Search

USPC ..... 430/108.6, 108.7, 109.1, 123.51; 399/222

See application file for complete search history.

(56) References Cited

U.S. PATENT DOCUMENTS

| | | | | |
|---|---|---|---|---|
| 8,722,293 | B2 * | 5/2014 | Iida et al. | 430/108.7 |
| 2007/0141506 | A1 * | 6/2007 | Inoue et al. | 430/137.15 |
| 2011/0318581 | A1 * | 12/2011 | Zenitani et al. | 428/402 |

FOREIGN PATENT DOCUMENTS

| | | |
|---|---|---|
| JP | A-2011-145321 | 7/2011 |

* cited by examiner

*Primary Examiner* — Peter Vajda
(74) *Attorney, Agent, or Firm* — Oliff PLC

(57) ABSTRACT

Provided is an electrostatic charge image developing toner including toner base particles which contain a polyester resin and a vinyl resin and does not have a coating layer and wherein the concentration of the polyester resin on the particle surface is higher than the concentration of the polyester resin in the inside of the particles, and a sol-gel silica which has an average circularity of from 0.75 to 0.9, on the surface of the toner base particles.

7 Claims, 2 Drawing Sheets

ELECTROSTATIC CHARGE IMAGE DEVELOPING TONER, ELECTROSTATIC CHARGE IMAGE DEVELOPER, TONER CARTRIDGE, DEVELOPING DEVICE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-274788 filed Dec. 17, 2012.

BACKGROUND

1. Technical Field

The present invention relates to an electrostatic charge image developing toner, an electrostatic charge image developer, a toner cartridge, a developing device, an image forming apparatus, and an image forming method.

2. Related Art

In recent years, a toner concurrently using a polyester resin and a vinyl resin as a resin has been under development.

SUMMARY

According to an aspect of the invention, there is provided an electrostatic charge image developing toner including toner base particle that contain a polyester resin and a vinyl resin and does not have a coating layer and in which the concentration of the polyester resin on the particle surface is higher than the concentration of the polyester resin in the inside of the particles, and sol-gel silica that has an average circularity of from 0.75 to 0.9, on the surface of the toner base particles.

BRIEF DESCRIPTION OF THE DRAWINGS

Exemplary embodiments of the present invention will be described in detail based on the following figures, wherein.

DETAILED DESCRIPTION

Figure 1:
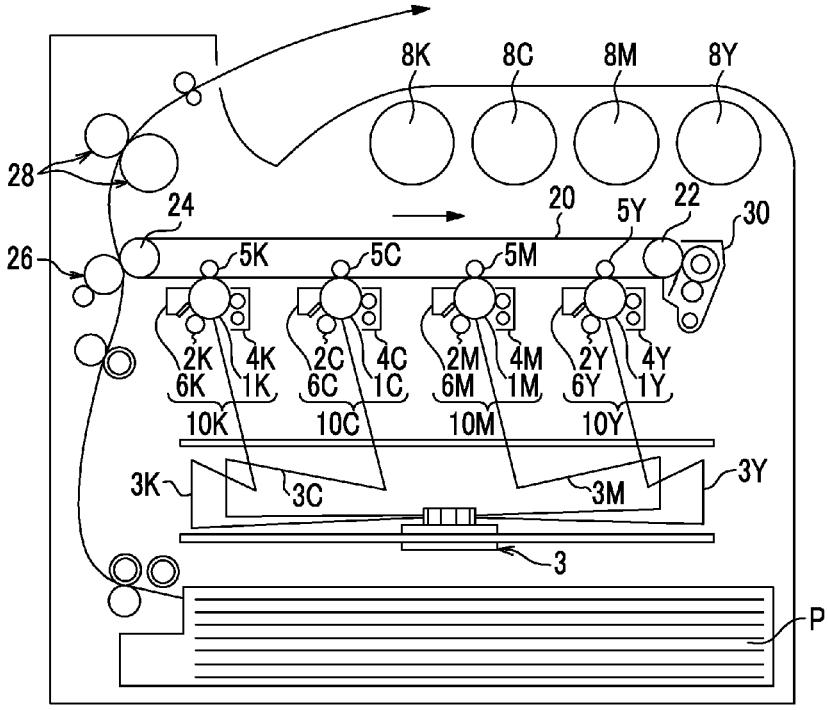
FIG. 1 is a schematic configurational view showing an example of the image forming apparatus according to the present exemplary embodiment.

Hereinafter, exemplary embodiments of the electrostatic charge image developing toner, the electrostatic charge image developer, the toner cartridge, the developing device, the image forming apparatus, and the image forming method of the invention will be described in detail.

Electrostatic Charge Image Developing Toner

The electrostatic charge image developing toner (hereinafter, simply called a "toner" in some cases) according to the present exemplary embodiment includes toner base particles and sol-gel silica on the surface of the toner base particles. The toner base particles contain a polyester resin and a vinyl resin and do not have a coating layer, and the concentration of the polyester resin on the particle surface is higher than the concentration of the polyester resin in the inside of the particles. Moreover, an average circularity of the sol-gel silica is from 0.75 to 0.9.

The words "do not have a coating layer" mean that the toner base particles are not configured with two or more layers and do not have an interface between layers. The words also mean that in forming the toner base particles, a step of forming another layer on the particle surface is not performed. Accordingly, the toner base particles of the present exemplary embodiment have a configuration not including a coating layer, and in the particles, the concentration of the polyester resin on the particle surface is higher than the concentration of the polyester resin in the inside of the particles. That is, the present exemplary embodiment does not include a toner that has a core-shell structure and is set such that the concentration of the polyester resin on the shell is higher than the concentration of the polyester resin in the core.

In recent years, in view of energy saving, a toner that may be fixed at a lower temperature has been under development. Generally, it is known that using a polyester resin as a resin is preferable since low-temperature fixability and heat-resistive storability become compatible with each other excellently, compared to a case of using a vinyl resin alone. Here, the polyester resin exhibits a high degree of hygroscopicity, and the charge amount is easily decreased at a high humidity. As a result, a transfer rate is decreased at a high humidity in some cases. Therefore, a toner concurrently using the polyester resin and the vinyl resin as a resin is under development. However, when a toner is prepared by, for example, a wet method, an ester group of the polyester resin easily moves to the interface between the resin and water during the process of making particles, and this makes it easier for the polyester resin to be present on the surface of the toner particles.

Meanwhile, external additives are added to a toner in general, and a toner obtained by externally adding sol-gel silica as an external additive to toner base particles is under development. In the toner to which the sol-gel silica has been externally added, the sol-gel silica covers the surface, and accordingly, moisture adsorption into the polyester resin may be suppressed. However, the toner generally has concavities and convexities on the surface, and due to stress caused in a developing unit, the sol-gel silica moves to the concavities. Accordingly, the toner surface is exposed, and as a result, the polyester resin, present in a larger amount on the surface, absorbs moisture. This leads to the decrease in the charge amount and the decrease in the transfer rate in some cases.

On the other hand, the sol-gel silica according to the present exemplary embodiment has an irregular shape having an average circularity 0.9 or less. Accordingly, it is considered that the sol-gel silica may be suppressed from transferring to the concavities of the surface of the toner base particles, whereby a coverage of the convexities of the surface of the toner base particles may be maintained. It is considered that for this reason, the moisture adsorption onto the toner surface may be suppressed, whereby the decrease in the charge amount may be suppressed. As a result, the decrease in the transfer rate is suppressed.

Concentration of Polyester Resin

In the present exemplary embodiment, the toner base particles contain a polyester resin and a vinyl resin, and the concentration of the polyester resin in the particle surface is higher than the concentration of the polyester resin in the inside of the particles. Herein, the method for confirming whether the concentration of the polyester resin on the surface of the toner base particles is higher than the concentration of the polyester resin in the inside of the particles will be described.

By using the pictures of the surface and inside of the toner, elements of catalysts (tin, titanium, and the like) used for synthesizing the polyester resin are relatively compared with each other by using a scanning electron microscopy device (manufactured by Hitachi Kyowa Engineering Co., Ltd., SEM-EDX). The picture of the toner surface is obtained by taking a picture of the surface enlarged 30,000× by using a scanning electron microscope (FE-SEM S-4100, manufactured by Hitachi, Ltd.). The picture of the inside of the toner is obtained in a manner in which the toner is embedded in an epoxy resin and the resultant is cut into pieces having a thickness of 100 nm by a microtome, and a picture enlarged 30,000× is taken using a scanning electron microscope (SEM).

Hereinafter, the configuration of the toner according to the present exemplary embodiment will be described in detail.

Sol-Gel Silica

Various Physical Properties

Average Circularity

The sol-gel silica (hereinafter, simply called "silica particles" in some cases) of the present exemplary embodiment has an average circularity (average circularity of primary particles) of from 0.75 to 0.9.

If the average circularity exceeds 0.9, the shape of the silica particles becomes close to a sphere. Accordingly, the silica particles are easily unevenly present in the concavities of the toner base particles, whereby the convexities of the toner base particles are exposed, making it difficult to control the moisture absorption into the surface of the toner base particles. If the average circularity is less than 0.75, the particles have a shape in which a ratio of length/width is high. Accordingly, when a mechanical load is applied to the silica particles, stress concentration occurs, whereby defects in the particles easily occur. Moreover, in a sol-gel method, it is practically impossible to prepare primary particles having an average circularity of less than 0.70.

The average circularity is more preferably from 0.75 to 0.85 and even more preferably from 0.77 to 0.83.

In order to obtain the circularity of primary particles, the primary particles obtained after dispersing silica particles (sol-gel silica) in resin particles (polyester, weight average molecular weight Mw=50,000) having a particle size of 100 μm are observed with an SEM device, and the obtained image of the primary particles is analyzed. From the result of the analysis, the circularity is obtained as "100/SF2" that is calculated by the following Formula (1).

$$\text{Circularity } (100/SF2) = 4\pi \times (A/I^2) \qquad \text{Formula (1)}$$

In Formula (1), I represents a perimeter of primary particles in the image, and A represents a projected area of the primary particles.

The average circularity of primary particles is obtained as a 50% circularity in a cumulative frequency of the circle-equivalent diameter of 100 primary particles obtained by the above image analysis. In addition, a circularity distribution index described later is obtained as a square root of a value obtained by dividing a 84% circularity in the cumulative frequency by a 16% circularity.

Circularity Distribution Index

It is preferable that the silica particles of the present exemplary embodiment have a circularity distribution index of primary particles of 1.05 to 1.50.

It is practically impossible to prepare particles having a circularity distribution index of less than 1.05. On the other hand, if the circularity distribution index is 1.50 or less, a ratio of minor axis/major axis of the primary particles is not heightened excessively. Moreover, dispersibility of the silica particles in the toner base particles is obtained, and the decrease in the strength or fluidity is suppressed.

The circularity distribution index of the primary particles is more preferably from 1.10 to 1.45.

Volume Average Particle Size

A volume average particle size (volume average particle size of primary particles) of the silica particles of the present exemplary embodiment is preferably from 70 nm to 200 nm.

If the volume average particle size of the primary particles is 70 nm or more, the shape of the particles is efficiently suppressed from becoming a sphere, and the average circularity may be effectively controlled within the above range. If the volume average particle size of the primary particles is 200 nm or less, the strength of the toner base particles is improved, and the fluidity of the toner base particles is efficiently improved.

The volume average particle size of the primary particles is more preferably from 80 nm to 180 nm and even more preferably from 90 nm to 160 nm.

The volume average particle size of the primary particles is measured using LS Coulter (a particle size analyzer manufactured by Beckman Coulter, Inc.). Based on the measured particle size distribution of the particles, a cumulative distribution is created from the small-size side for the volume of each particle within divided ranges (channels) of the particle size, and a particle size reaching cumulative 50% is defined as a volume average particle size (D50v).

Particle Size Distribution Index

A particle size distribution index of the primary particles of the silica particles of the present exemplary embodiment is preferably from 1.10 to 1.40.

It is practically impossible to prepare silica particles having a particle size distribution index of the primary particles of less than 1.10. On the other hand, if the particle size distribution index of the primary particles is 1.40 or less, formation of coarse particles is suppressed, and the dispersibility of the silica particles in the toner base particles is obtained.

The particle size distribution index of the primary particles is more preferably from 1.10 to 1.25.

The particle size distribution index of the primary particles is measured using LS Coulter (a particle size analyzer manufactured by Beckman Coulter, Inc.). Based on the measured particle size distribution of the particles, a cumulative distribution is created from the small-size side for the volume of each particle within divided ranges (channels) of the particle size, and a square root of a value which is obtained by dividing a particle size D84v reaching cumulative 84% by a particle size D16v reaching cumulative 16% is defined as a particle size distribution index (GSDv). That is, the particle size distribution index $(GSDv)=(D84v/D16v)^{0.5}$.

Ratio Between Maximum Height and Circle-Equivalent Diameter

In the silica particles of the present exemplary embodiment, an average of a ratio (Da/H) of a circle-equivalent diameter (Da) obtained by planar image analysis to a maximum height (H) obtained by three-dimensional image analysis is preferably from 1.5 to 1.9.

It is considered that if the average of the ratio (Da/H) is 1.5 or higher, the shape of the silica particles may be further flattened, and accordingly, the movement of the silica particles to the concavities of the toner base particles may be more effectively suppressed. In addition, moisture absorption into the surface of the toner base particles is suppressed. If the average of the ratio (Da/H) is 1.9 or less, the ratio of length/width of the particles is not excessively heightened. Accordingly, even when a mechanical load is applied to the silica particles, stress concentration is reduced, whereby defect of the particle is suppressed.

The average of the ratio (Da/H) is more preferably from 1.6 to 1.85, and even more preferably from 1.65 to 1.8.

The maximum height H and the circle-equivalent diameter Da of the silica particles are obtained in the following procedure.

The particles obtained by dispersing and attaching silica particles to zirconia beads with smooth surface that have a particle size of 100 μm are used to analyze the height in the X-Y axis direction for every 10 nm, in a visual field of 10,000 magnification, by using an electron beam three-dimensional roughness analyzer (ERA-8900: manufactured by Elionix, Inc.) and the height is obtained. In addition, a two-dimensional image of a magnification of 10,000 is captured in the same visual field.

Thereafter, by using the two-dimensional image, the circle-equivalent diameter Da is obtained by the following Formula (2), from an area that is determined using image analysis software WinROOF (manufactured by MITANI CORPORATION) under a condition of 0.010000 μm/pixel, and a particle number is marked on each particle.

$$\text{Circle-equivalent diameter}=2\sqrt{(\text{area}/\pi)} \qquad \text{Formula (2)}$$

In addition, the analyzed numerical value of the height is made into an image by conditional formatting (double color scale) by using spreadsheet software Microsoft Excel (manufactured by Microsoft) to match each particle with the above particle number, thereby calculating the maximum height for each particle number of each particle.

Moreover, the average of Da/H is an average of 100 silica particles measured.

Components and Surface Treatment

It is sufficient that the silica particles of the present exemplary embodiment may be particles that are prepared by a sol-gel method containing silica, that is, $SiO_2$ as a main component, and may be crystalline or amorphous.

In addition, in view of dispersibility of the silica particles, it is preferable that hydrophobizing treatment be performed on the surface of the silica particles. For example, if the surface of the silica particles is covered with an alkyl group, the silica particles are hydrophobized. Examples of the method of the hydrophobizing treatment include a method of performing hydrophobizing treatment by using a hydrophobizing agent in a supercritical carbon dioxide atmosphere, a method of causing a hydrophobizing agent such as an alkyl group to bind to the surface of sol-gel silica, and the like. The detail of the method of hydrophobizing treatment will be described later.

Method for Preparing Silica Particles (Sol-Gel Silica)

The silica particles of the present exemplary embodiment may be prepared by, for example, a so-called wet method in which the particles are generated by a sol-gel method by using a silicon compound represented by alkoxysilane as a raw material.

It is preferable that the silica particles of the present exemplary embodiment have an average circularity of 0.75 to 0.9, and various physical properties thereof are preferably within the above range. In order to prepare the silica particles having various physical properties as above, it is preferable to use a preparation method including the following steps.

The method for preparing the silica particles preferably includes (1) a step of preparing an alkaline catalyst solution in which an alkaline catalyst is contained in an alcohol-containing solvent, at a concentration of 0.6 mol/L to 0.85 mol/L, and (2) a step of supplying tetraalkoxysilane into the alkaline catalyst solution, in a supply amount of equal to or more than 0.002 mol/(mol-min) and less than 0.008 mol/(mol/·min) based on the alcohol, and supplying an alkaline catalyst in an amount of 0.1 mol to 0.4 mol, based on 1 mol of a total amount of the tetraalkoxysilane supplied per minute.

That is, in the method for preparing silica particles, while the tetraalkoxysilane as a raw material and the alkaline catalyst as a catalyst are being respectively supplied in the above relationship, in the presence of the alcohol containing the alkaline catalyst at the above concentration, the tetraalkoxysilane is reacted to generate the silica particles.

In the method for preparing silica particles, by the above technique, silica particles having an irregular shape that generate less coarse aggregates are obtained.

Herein, the amount of tetraalkoxysilane supplied is considered to be involved in the particle size distribution or circularity of the silica particles. It is considered that if the amount of tetraalkoxysilane supplied is set to be equal to or more than 0.002 mol/(mol·min) and less than 0.006 mol/(mol·min), the probability that the tetraalkoxysilane added dropwise will contact core particles may be decreased, whereby the tetraalkoxysilane may be evenly supplied to the core particles before a reaction is caused between the tetraalkoxysilane molecules. Therefore, it is considered that a reaction between the tetraalkoxysilane and the core particles may be evenly caused. As a result, it is considered that variation in particle growth may be suppressed, and silica particles showing a narrow distribution width may be obtained.

Therefore, it is considered that if the amount of the tetraalkoxysilane supplied is set within the above range, the silica particles (primary particles) of which the average circularity or the various physical properties described above are within the above range may be easily obtained.

It is also considered that the volume average particle size of the silica particles may depend on the total amount of the tetraalkoxysilane supplied.

First, the step of preparing an alkaline catalyst solution will be described.

In the step of preparing an alkaline catalyst solution, an alcohol-containing solvent is prepared, and an alkaline catalyst is added thereto, thereby preparing an alkaline catalyst solution.

The alcohol-containing solvent may be a solvent containing only alcohol, or a mixed solvent mixed with another solvent such as water, ketones such as acetone, methyl ethyl ketone, and methyl isobutyl ketone, cellosolves such as methyl cellosolve, ethyl cellosolve, butyl cellosolve, and acetic acid cellosolve, and ethers such as dioxane and tetrahydrofuran. When the alcohol-containing solvent is a mixed solvent, the proportion of alcohol in the mixed solvent is preferably 80% by weight or more and more preferably 90% by weight or more.

In addition, examples of the alcohol include lower alcohol such as methanol or ethanol.

Meanwhile, the alkaline catalyst is a catalyst for accelerating the reaction (hydrolysis reaction or condensation reaction) of the tetraalkoxysilane. Examples thereof include basic catalysts such as ammonia, urea, monoamine, and a quaternary ammonium salt, and among these, ammonia is particularly preferable.

The concentration (content) of the alkaline catalyst is preferably from 0.6 mol/L to 0.85 mol/L, more preferably 0.63 mol/L to 0.78 mol/L, and even more preferably from 0.66 mol/L to 0.75 mol/L.

If the concentration of the alkaline catalyst is 0.6 mol/L or higher, dispersibility of the generated core particles in the growing process is obtained. In addition, the generation of coarse aggregates such as secondary aggregates is decreased, whereby the particles are suppressed from being gelated, and the particle size distribution is controlled within a preferable range.

On the other hand, if the concentration of the alkaline catalyst is 0.85 mol/L or less, the generated core particles are not stabilized too much, and the generation of core particles having the shape of a perfect sphere is suppressed. Accordingly, silica particles having an irregular shape are obtained.

In addition, the concentration of the alkaline catalyst is a concentration based on the alcohol catalyst solvent (alkaline catalyst+alcohol-containing solvent).

Next, the step of generating particles will be described.

The step of generating particles is a step of generating silica particles by supplying the tetraalkoxysilane and the alkaline catalyst respectively into the alkaline catalyst solution and causing a reaction (a hydrolysis reaction or a condensation reaction) of the tetraalkoxysilane in the alkaline catalyst solution.

In the step of generating particles, core particles are generated by the reaction of the tetraalkoxysilane at the initial stage of supplying the tetraalkoxysilane (core particle generation stage), and then the core particles are allowed to grow (core particle growth stage), whereby the silica particles are generated.

Examples of the tetraalkoxysilane supplied into the alkaline catalyst solution include tetramethoxysilane, tetraethoxysilane, tetrapropoxysilane, tetrabutoxysilane, and the like. In view of the controllability of the reaction rate or the shape, particle size, particle size distribution, and the like of the obtained silica particles, tetramethoxysilane and tetraethoxysilane are preferable.

The amount of the tetraalkoxysilane supplied is preferably equal to or more than 0.002 mol/(mol·min) and less than 0.011 mol/(mol·min), based on the alcohol in the alkaline catalyst solution.

This means that the tetraalkoxysilane is supplied in an amount of equal to or more than 0.002 mol and less than 0.011 mol per minute, based on 1 mol of the alcohol used in the step of preparing an alkaline catalyst solution.

If the amount of the tetraalkoxysilane supplied is within the above range, the above various physical properties of the primary particles may be efficiently adjusted within the above range.

Moreover, regarding the particle size of the silica particles, if the total amount of the supplied tetraalkoxysilane used in the reaction of particle generation is set to, for example, 0.855 mol to 3.288 mol based on 1 L of the silica particle dispersion, the volume average particle size may be efficiently adjusted within the above range, though the particle size also depends on the type of the tetraalkoxysilane or the reaction condition.

The supply rate of the tetraalkoxysilane is more preferably from 0.001 mol/(mol·min) to 0.01 mol/(mol·min), and even more preferably from 0.002 mol/(mol·min) to 0.0033 mol/(mol·min).

Meanwhile, examples of the alkaline catalyst supplied into the alkaline catalyst solution include those exemplified above. The alkaline catalyst supplied may be the same type as the alkaline catalyst that has already been contained in the alkaline catalyst solution, or may be a different type. It is preferable that the alkaline catalyst is the same type of catalyst.

The amount of the alkaline catalyst supplied is preferably from 0.1 mol to 0.4 mol, more preferably from 0.14 mol to 0.35 mol, and even more preferably from 0.18 mol to 0.30 mol, based on 1 mol of a total amount of the tetraalkoxysilane supplied per minute.

If the amount of the alkaline catalyst supplied is 0.1 mol or more, dispersibility of the generated core particles in the process of growth is obtained. In addition, the generation of coarse aggregates such as secondary aggregates is decreased, whereby the particles are suppressed from being gelated, and the particle size distribution is controlled within a preferable range.

On the other hand, if the amount of the alkaline catalyst supplied is 0.4 mol or less, the generated core particles are not stabilized too much, and the core particles having an irregular shape that are generated in the core particle generation stage are suppressed from growing into a spherical shape in the core particle growth stage. Accordingly, silica particles having an irregular shape are obtained.

Herein, in the step of generating particles, the tetraalkoxysilane and the alkaline catalyst are respectively supplied into the alkaline catalyst solution. The supply method may be a method of continuous supply or a method of intermittent supply.

In the step of generating particles, the temperature of the alkaline catalyst solution (temperature at the time of supply) is preferably, for example, from 5° C. to 50° C., and more preferably in a range of 15° C. to 40° C.

Through the above steps, the silica particles are obtained. In this state, the silica particles are obtained in a state of dispersion. The silica particles may be used directly as the silica particle dispersion, or may be used as powder of the silica particles taken after removal of the solvent.

Hydrophobizing Treatment

The silica particles obtained as described above are hydrophilic silica particles. Accordingly, it is preferable that hydrophobizing treatment be performed on the particles.

As one of the hydrophobizing treatment, a method of performing hydrophobizing treatment on the surface of the silica particles by using a hydrophobizing agent in a supercritical carbon dioxide atmosphere is exemplified.

By the above technique, hydrophobic silica particles in which environment-dependent change in moisture content is suppressed are obtained. Though unclear, the reason is considered to be as follows.

It is considered that when the hydrophobizing treatment is performed on the surface of the hydrophilic silica particles by using a hydrophobizing agent, if the treatment is performed in supercritical carbon dioxide, a state where the hydrophobizing agent is dissolved in the supercritical carbon dioxide may be created. The supercritical carbon dioxide has a characteristic that the interfacial tension thereof is extremely low. Therefore, it is considered that the hydrophobizing agent in a state of being dissolved in the supercritical carbon dioxide may be easily diffused and reach deep inside the pores of the surface of the hydrophilic silica particles together with the supercritical carbon dioxide. It is considered that for this reason, the hydrophobizing treatment may be performed not only on the surface of the hydrophilic silica particles but also in the portion deep inside the pores.

It is considered that for this reason, in the hydrophobic silica particles having undergone the hydrophobizing treatment in the supercritical carbon dioxide atmosphere, the environment-dependent change in the moisture content may be suppressed.

Particularly, in the present exemplary embodiment, since the hydrophilic silica particles to be treated are hydrophilic silica particles (sol-gel silica) obtained by a sol-gel method, the amount of a silanol group present per surface area of the silica particles is larger in the hydrophilic silica particles obtained by a sol-gel method than in, for example, hydrophilic silica particles obtained by a gas-phase method. Therefore, it is considered that the amount of water adsorbed onto the surface of the silica particles may also be large. Consequently, it is considered that the hydrophobizing treatment is performed in a state of adsorbing a large amount of water and the hydrophobic silica particles may be obtained which has a high moisture content and in which the environment-dependent change in the moisture content is suppressed.

It is also considered that if the hydrophobizing treatment is performed in supercritical carbon dioxide, the hydrophobic silica particles may be obtained in which a decomposition product of the hydrophobizing agent or the alkaline catalyst (for example, ammonia) used in the sol-gel method remains in a small amount. It is considered that this may be because those residues easily transfer to the supercritical carbon dioxide.

Particularly, in the related art, the alkaline catalyst (for example, ammonia) used in the sol-gel method needs to be removed by drying at a high temperature. However, if the hydrophobizing treatment is performed in the supercritical carbon dioxide, it is possible to remove the alkaline catalyst at a lower temperature. It is considered that for this reason, the generation of coarse aggregates of the silica particles that is caused by the drying at a high temperature may be suppressed.

As a result, a step of removing the residues may not be performed.

In addition, it is considered that if the hydrophobizing treatment is performed in the supercritical carbon dioxide, the hydrophobizing treatment may be performed with a small amount of the hydrophobizing agent for a shorter time, in a state where unevenness is further suppressed. Moreover, generation of coarse aggregates is also suppressed. It is considered that this may be because the hydrophobizing agent dissolved in the supercritical carbon dioxide easily reaches the surface of the hydrophilic silica particles due to the supercritical carbon dioxide.

In this respect, the method for preparing hydrophobic silica particles described above is more desirable, compared to dry-type hydrophobizing treatment of the related art in which the particles are easily aggregated, and the treatment not showing unevenness is not easily realized, or a wet-type hydrophobizing treatment of the related art that requires a large amount of the hydrophobizing agent and consumes a long treatment time for realizing treatment not showing unevenness.

Hereinafter, the method of performing the hydrophobizing treatment in the supercritical carbon dioxide atmosphere by using a hydrophobizing agent will be described in detail.

In this method, specifically, hydrophilic silica particles (the sol-gel silica of the present exemplary embodiment) are put into, for example, a closed reaction container, and then a hydrophobizing agent is added to the hydrophilic silica particles. Thereafter, liquefied carbon dioxide is added into the closed reaction container, followed by heating, and the internal pressure of the reactor is increased using a high-pressure pump to create a supercritical state of the carbon dioxide. Subsequently, while the supercritical state of carbon dioxide is being maintained, that is, in the supercritical carbon dioxide, the hydrophobizing agent is reacted to perform the hydrophobizing treatment of the hydrophilic silica particles. After the reaction ends, the internal pressure of the closed reactor is reduced, followed by cooling.

Herein, the supercritical carbon dioxide refers to carbon dioxide in a state that is under a temperature and pressure equal to or higher than a critical point, and has both the diffusivity of gas and solubility of liquid.

The amount of the hydrophilic silica particles (that is, the amount of silica particles put into the reactor) based on the volume of the reactor is preferably, for example, from 50 g/L to 600 g/L, more preferably from 100 g/L to 500 g/L and even more preferably from 150 g/L to 400 g/L.

If the amount is equal to or larger than the above range, the concentration of the hydrophobizing agent based on the supercritical carbon dioxide is not lowered too much, and the decrease in probability that the hydrophobizing agent will contact the silica surface is suppressed, whereby the hydrophobizing reaction proceeds excellently. On the other hand, if the amount is equal to or smaller than the above range, the concentration of the hydrophobizing agent based on the supercritical carbon dioxide is not heightened too much, and a phenomenon in which the hydrophobizing agent is not sufficiently dissolved in the supercritical carbon dioxide and exhibits dispersion defectiveness is decreased, whereby the generation of coarse aggregates is suppressed.

The density of the supercritical carbon dioxide may be, for example, from 0.10 g/ml to 0.60 g/ml, and preferably from 0.10 g/ml to 0.50 g/ml and more preferably from 0.2 g/ml to 0.30 g/ml.

If the density is equal to or higher than the above range, the decrease in the solubility of the hydrophobizing agent in the supercritical carbon dioxide is suppressed, whereby the generation of aggregates is suppressed. On the other hand, if the density is equal to or lower than the above range, the decrease in the diffusivity of the hydrophobizing agent into the pores of silica is suppressed, whereby the hydrophobizing treatment is efficiently performed. Particularly, for silica particles containing a large amount of silanol groups, hydrophobizing treatment performed within the above density range is preferable.

In addition, the density of the supercritical carbon dioxide is adjusted by temperature, pressure, and the like.

Examples of the hydrophobizing agent include known organic silicon compounds having an alkyl group (for example, a methyl group, an ethyl group, a propyl group, or a butyl group). Specific examples thereof include silazane compounds (for example, silane compounds such as methyl trimethoxysilane, dimethyl dimethoxysilane, trimethyl chlorosilane, and trimethyl methoxysilane, hexamethyl disilazane, and tetramethyl disilazane), and the like. One kind of the hydrophobizing agent may be used, or plural kinds thereof may be used.

Among these hydrophobizing agents, organic silicon compounds having a trimethyl group, such as trimethyl methoxysilane and hexamethyl disilazane are preferable.

The amount of the hydrophobizing agent used is not particularly limited. However, in view of obtaining the hydrophobizing effect, the amount may be, for example, from 1% by weight to 60% by weight, and preferably from 5% by weight to 40% by weight and more preferably from 10% by weight to 30% by weight, based on the hydrophilic silica particles.

Herein, the temperature condition of the hydrophobizing treatment (temperature condition under the reaction), that is, the temperature of the supercritical carbon dioxide may be, for example, from 140° C. to 210° C., and preferably from 155° C. to 185° C., and more preferably from 165° C. to 175° C.

Meanwhile, the pressure condition of the hydrophobizing treatment (pressure condition under the reaction), that is, the pressure of the supercritical carbon dioxide just needs to be under a condition satisfying the above density. The pressure may be, for example, from 8 MPa to 30 MPa, and preferably from 10 MPa to 25 MPa and more preferably from 15 MPa to 20 MPa.

Through the step of performing the hydrophobizing treatment described above, the hydrophobic silica particles are obtained.

Toner Base Particles

The toner base particles of the present exemplary embodiment contain a polyester resin and a vinyl resin and do not have a coating layer, wherein the concentration of the polyester resin on the particle surface is higher than the concentration of the polyester resin in the inside of the particles. In addition, the toner base particles may further contain other additives such as a colorant or a release agent.

First, a binder resin will be described.

As the binder resin, at least a polyester resin and a vinyl resin are used.

Polyester Resin

Examples of the polyester resin include those obtained by condensation polymerization caused mainly between polyvalent carboxylic acids and polyols. The polyester resin may be configured with one kind of polyester resin, or may be a mixture of two or more kinds of polyester resins.

The polyvalent carboxylic acid is not particularly limited, and for example, the monomer component (divalent carboxylic acid or carboxylic acid having a valency of 3 or higher that is known in the related art) disclosed in "Handbook of polymer data: basic level" (edited by The Society of Polymer Science, Japan, Baifukan Co., Ltd.) may be used.

Among the polyvalent carboxylic acids, examples of divalent carboxylic acid include dibasic acids such as alkyl succinate, alkenyl succinate, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid, anhydrides and lower alkyl esters thereof, aliphatic unsaturated dicarboxylic acids such as maleic acid, fumaric acid, itaconic acid, and citraconic acid, and the like.

Examples of the alkyl succinate and alkenyl succinate include n-butyl succinate, n-butenyl succinate, isobutyl succinate, isobutenyl succinate, n-octyl succinate, n-octenyl succinate, n-dodecyl succinate, n-dodecenyl succinate, isododecyl succinate, isododecenyl succinate, and the like.

Among the polyvalent carboxylic acids, examples of the carboxylic acid having a valency of 3 or higher include 1,2,4-benzene tricarboxylic acid (trimellitic acid), 1,2,5-benzene tricarboxylic acid, 1,2,4-naphthalene tricarboxylic acid, anhydrides and lower alkyl esters thereof, and the like.

One kind of the polyvalent carboxylic acid may be used alone, or two or more kinds thereof may be used concurrently.

As the polyvalent carboxylic acid, adipic acid, alkenyl succinate, and terephthalic acid are particularly preferable, and alkenyl succinate and terephthalic acid are preferable.

The polyol is not particularly limited, and for example, the monomer component (diol or alcohol having a valency of 3 or higher that is known in the related art) disclosed in "Handbook of polymer data: basic level" (edited by The Society of Polymer Science, Japan, Baifukan Co., Ltd.) may be used.

Examples of the polyol include aliphatic diols such as ethylene glycol, diethylene glycol, triethylene glycol, propylene glycol, butanediol, hexanediol, neopentyl glycol, and glycerin, alicyclic diols such as cyclohexanediol, cyclohexane dimethanol, and hydrogenated bisphenol A, aromatic diols such as an ethylene oxide adduct of bisphenol A and a propylene oxide adduct of bisphenol A, and the like.

Among the polyols, examples of the alcohol having a valency of 3 or higher include glycerin, trimethylolethane, trimethylolpropane, pentaerythritol, and the like.

One kind of the polyol may be used alone, or two or more kinds thereof may be used concurrently.

As the polyol, bisphenol A is particularly preferable, and specifically, an alkylene oxide adduct of bisphenol A (an ethylene oxide adduct of bisphenol A, a propylene oxide adduct of bisphenol A, or the like) is preferable.

The weight average molecular weight (Mw) of the polyester resin is in a range of 12,000 to 200,000 for example. The weight average molecular weight may be in a range of 14,000 to 140,000 or may be in a range of 16,000 to 120,000.

The number average molecular weight (Mn) of the polyester resin is in a range of 4,000 to 20,000 for example, and may be in a range of 5,000 to 120,000.

In addition, the molecular weight distribution of the polyester resin is in a range of 2 to 15 for example, in terms of the value of Mw/Mn as an index of the molecular weight distribution.

The glass transition temperature of the polyester resin is in a range of 30° C. to 90° C. for example. The glass transition temperature may be in a range of 30° C. to 80° C. or may be in a range of 50° C. to 70° C.

Vinyl Resin

Examples of the vinyl resin include styrene, styrene derivatives, homopolymers of acrylic monomers and the like, and copolymers thereof.

Examples of the styrene derivative include alkyl-substituted styrene having an alkyl chain, such as α-methylstyrene, 4-methylstyrene, vinylnaphthalene, 2-methylstyrene, 3-methylstyrene, 2-ethylstyrene, 3-ethylstyrene, and 4-ethylstyrene, halogen-substituted styrene such as 2-chlorostyrene, 3-chlorostyrene, and 4-chlorostyrene, fluorine-substituted styrene such as 4-fluorostyrene and 2,5-difluorostyerne, and the like.

Examples of the acrylic monomer include (meth)acrylic acid esters such as (meth)acrylic acid, n-methyl(meth)acrylate, n-ethyl(meth)acrylate, n-propyl(meth)acrylate, n-butyl(meth)acrylate, n-pentyl(meth)acrylate, n-hexyl(meth)acrylate, n-heptyl(meth)acrylate, n-octyl(meth)acrylate, n-decyl(meth)acrylate, n-dodecyl(meth)acrylate, n-lauryl(meth)acrylate, n-tetradecyl(meth)acrylate, n-hexadexyl(meth)acrylate, n-octadecyl(meth)acrylate, isopropyl(meth)acrylate, isobutyl(meth)acrylate, t-butyl(meth)acrylate, isopentyl(meth)acrylate, amyl(meth)acrylate, neopentyl(meth)acrylate, isohexyl(meth)acrylate, isoheptyl(meth)acrylate, isooctyl(meth)acrylate, 2-ethylhexyl(meth)acrylate, phenyl(meth)acrylate, biphenyl(meth)acrylate, diphenylethyl(meth)acrylate, t-butylphenyl(meth)acrylate, terphenyl(meth)acrylate, cyclohexyl(meth)acrylate, t-butylcyclohexyl(meth)acrylate, dimethyl aminoethyl(meth)acrylate, diethyl aminoethyl(meth)acrylate, methoxyethyl(meth)acrylate, 2-hydroxyethyl(meth)acrylate, and β-carboxyethyl(meth)acrylate, acrylonitrile, and the like.

Specific examples of the vinyl resin include known materials such as polystyrene, a styrene-acrylic acid copolymer, a styrene-methacrylic acid copolymer, a styrene-alkyl acrylate copolymer, a styrene-alkyl methacrylate copolymer, a styrene-acrylonitrile copolymer, a styrene-butadiene copolymer, and a styrene-maleic anhydride copolymer. Among these, a styrene-acrylic acid copolymer, a styrene-methacrylic acid copolymer, and a styrene-alkyl acrylate copolymer are preferable, and a styrene-acrylic acid copolymer is more preferable.

As the vinyl resin, those having a weight average molecular weight Mw of 20,000 to 100,000 and a number average molecular weight Mn of 2,000 to 30,000 are preferably used.

The molecular weight (Mn and Mw) of the respective resin and toner is measured using HLC8120GPC, GPC manufactured by Tosoh Corporation. In addition, the glass transition temperature (Tg) is measured as an extrapolation glass transition start temperature of JIS K 7121-1987 (method for measuring transition temperatures of plastics), by using DSC60, DSC manufactured by Shimadzu Corporation.

The total content of the polyester resin and the vinyl resin as a binder resin is, for example, in a range of 75% by weight to 100% by weight based on the entire toner base particles. The total content is more preferably in a range of 80% by weight to 95% by weight.

The weight ratio between the polyester resin and the vinyl resin (polyester resin/vinyl resin) is preferably from 3/100 to 50/100 and more preferably from 5/100 to 20/100.

Colorant

Examples of the colorant include known inorganic or organic pigments or dyes, oil-soluble dyes, and the like.

As black pigments, carbon black, magnetic powder, and the like are exemplified.

Examples of yellow pigments include Hansa Yellow, Hansa Yellow 10G, benzidine yellow G, benzidine yellow GR, threne yellow, quinoline yellow, permanent yellow NCG, C. I. Pigment Yellow 74, and the like.

Examples of red pigments include red iron oxide, watching red, permanent red 4R, lithol red, brilliant carmine 3B, brilliant carmine 6B, DuPont oil red, pyrazolone red, rhodamine B lake, lake red C, rose bengal, eosine red, alizarin lake, and the like.

Examples of blue pigments include iron blue, cobalt blue, alkali blue lake, Victoria blue lake, fast sky blue, indathrene blue BC, aniline blue, ultramarine blue, calco oil blue, methylene blue chloride, phthalocyanine blue, phthalocyanine green, malachite green oxalate, and the like.

As the colorant, C. I. Pigment Yellow 74 is preferably exemplified.

In addition, the above colorants may be used by being mixed with each other, or used in a state of a solid solution.

Among the components configuring the toner base particles, the content of the colorant may be, for example, in a range of 2% by weight to 15% by weight, and preferably in a range of 3% by weight to 10% by weight.

Release Agent

The release agent is not particularly limited, and examples thereof include petroleum wax, mineral wax, wax from animal or plant, synthetic wax such as polyolefin wax, polyolefin oxide wax, Fischer-Tropsch wax, and the like. A melt temperature of the release agent may be, for example, from 40° C. to 150° C. and preferably from 50° C. to 120° C.

Among the components configuring the toner base particles, the content of the release agent may be, for example, in a range of 1% by weight to 10% by weight, and preferably in a range of 2% by weight to 8% by weight.

Other Components

The toner base particles may also contain other components in addition to the above. Examples of those other components include various components such as internal additives, charge-controlling agent, and inorganic powder (inorganic particles).

Examples of the internal additives include metals such as ferrite, magnetite, reduced iron, cobalt, nickel, and manganese, alloys, and magnetic materials such as compounds including these metals.

Examples of the charge-controlling agent include a compound selected from a group consisting of a metal salt of benzoic acid, a metal salt of salicylic acid, a metal salt of alkyl salicylate, a metal salt of catechol, a metal-containing bisazo dye, a tetraphenyl borate derivative, a quaternary ammonium salt, and an alkyl pyridinium salt; a polar group-containing resin type charge-controlling agent; and the like.

Examples of the inorganic particles include known inorganic particles such as silica particles, titanium oxide particles, alumina particles, cerium oxide particles, and particles obtained by performing hydrophobizing treatment on the surface of these particles. These inorganic particles may be subjected to various types of surface treatment using, for example, a silane coupling agent, a titanium coupling agent, or a silicone oil.

Physical Properties of Toner Base Particles

The volume average particle size of the toner base particles is, for example, from 2.0 μm to 10 μm, and preferably from 4.0 μm to 8.0 μm.

In addition, examples of the method of measuring the volume average particle size of the toner base particles include the following methods. First, a measurement sample in an amount of 0.5 mg to 50 mg is added to a surfactant as a dispersant, preferably in 2 ml of an aqueous solution including 5% by weight of sodium alkylbenzene sulfonate, and the resultant is added to an electrolyte solution which is in an amount of 100 ml to 150 ml. The electrolyte solution in which the measurement sample is suspended is subjected to dispersion treatment for 1 minute by using an ultrasonic dispersion device. In addition, by using a Coulter Multisizer II (manufactured by Beckman Coulter, Inc.) and an aperture having a diameter of 50 μm, the particle size distribution of particles having a particle size in a range of 1.0 μm to 30 μm is measured. The number of particles measured is 50,000. Based on the obtained particle size distribution, a cumulative volume distribution is created from the small-size side within divided ranges (channels) of the particle size, and a particle size reaching cumulative 50% is defined as a volume average particle size D50v.

When powder such as the external additive is measured, 2 g of a measurement sample is added to 50 ml of 5% aqueous solution of the surfactant, preferably sodium alkylbenzene sulfonate, and the solution is dispersed for 2 minutes by using an ultrasonic dispersion device (1,000 Hz) to prepare a sample. By the above method used for the sample in a state of dispersion, the volume average particle size is measured.

A shape factor SF1 of the toner base particles is, for example, in a range of 120 to 160.

The shape factor SF1 is obtained by the following formula.

Formula: $SF1=(ML^2/A)\times(\pi/4)\times 100$

In the Formula, ML represents an absolute maximum length of the toner base particles, and A represents a projected area of the toner base particles.

SF1 is converted into a numerical value by analyzing, for example, microscopic images or images of a scanning electron microscope (SEM) by using an image analyzer. Specifically, for example, optical microscopic images of the toner dispersed on the surface of a slide glass are provided to a Luzex image analyzer through a video camera, the maximum length and the projected area of 50 or more toner base particles are obtained and calculated by the above formula, and an average thereof is calculated, thereby obtaining SF1.

Method for Preparing Toner Base Particles

Next, the method for preparing toner base particles will be described.

The toner base particles are obtained by aggregating and coalescing the respective particles in a raw material dispersion which is obtained by dispersing the polyester resin particles and the vinyl resin particles in an aqueous medium, or in a raw material dispersion which is obtained by dispersing resin particles including both the polyester resin and the vinyl resin in an aqueous medium.

Hereinafter, an example of the method for preparing toner base particles will be described in detail.

Here, in the following description, the term "resin particles" refers to at least the polyester resin particles and the vinyl resin particles, or refers to at least resin particles including both the polyester resin and the vinyl resin.

In addition, the method for obtaining toner base particles containing a release agent will be described, but the release agent may not be contained in the toner base particles. Needless to say, additives other than the colorant and the release agent may also be used.

Step of Preparing Resin Particle Dispersion

First, for example, a colorant particle dispersion in which colorant particles are dispersed, and a release agent dispersion in which release agent particles are dispersed are prepared together with a resin particle dispersion in which resin particles are dispersed.

Herein, the resin particle dispersion is prepared by, for example, dispersing resin particles in a dispersion medium by using a surfactant.

Examples of the dispersion medium used for the resin particle dispersion include an aqueous medium.

Examples of the aqueous medium include water such as distilled water and deionized water, alcohols, and the like. One kind of these may be used alone, or two or more kinds of these may be used concurrently.

The surfactant is not particularly limited, and examples thereof include anionic surfactants based on a sulfuric acid ester salt, a sulfonic acid salt, a phosphoric acid ester, a soap, and the like; cationic surfactants such as an amine salt type surfactant and a quaternary ammonium salt type surfactant; nonionic surfactants based on polyethylene glycol, an alkylphenol ethylene oxide adduct, a polyol, and the like. Among these, anionic surfactants and cationic surfactants are particularly preferable. The nonionic surfactants may be concurrently used with the anionic surfactants or the cationic surfactants.

One kind of the surfactant may be used alone, or two or more kinds thereof may be used concurrently.

Examples of the method for dispersing the resin particles in a dispersion medium in the resin particle dispersion include general dispersion methods using a rotating shear type homogenizer, a ball mill including media, a sand mill, a dyno mill, or the like. Moreover, depending on the type of the resin particles used, the resin particles may be dispersed in the resin particle dispersion by using, for example, a phase inversion emulsification method.

The phase inversion emulsification method is a method in which a resin to be dispersed is dissolved in a hydrophobic organic solvent that is able to dissolve the resin, a base is then added thereto in an organic continuous phase (O phase) to neutralize the solution, and then an aqueous medium (W phase) is added to the resultant. In this manner, the resin is converted from W/O to O/W (so-called phase inversion) and becomes a discontinuous phase, whereby the resin is dispersed in the shape of particles in the aqueous medium.

The volume average particle size of the resin particles to be dispersed in the resin particle dispersion is, for example, in a range of 0.01 μm to 1 μm, and may be in a range of 0.08 μm to 0.8 μm or in a range of 0.1 μm to 0.6 μm.

The volume average particle size of the resin particles is measured by laser diffraction type particle size distribution analyzer (LA-920 manufactured by HORIBA, Ltd.).

The content of the resin particles included in the resin particle dispersion is, for example, from 5% by weight to 50% by weight, and may be from 10% by weight to 40% by weight.

In addition, for example, a colorant dispersion or a release agent dispersion is prepared by applying the dispersion method used for the resin particles. That is, the volume average particle size of particles, dispersion medium, dispersion method, and content of particles in the resin particle dispersion are equally applied to colorant particles dispersed in the colorant dispersion and release agent particles dispersed in the release agent dispersion.

Step of Forming Aggregated Particles

Next, the resin particle dispersion is mixed with the colorant particle dispersion or the release agent dispersion.

Subsequently, the resin particles as a binder resin, the colorant particles, and the release agent particles are heteroaggregated in the mixed dispersion, thereby forming aggregated particles which include the resin particles, the colorant particles, and the release agent particles and have a size close to the target size of the toner base particles.

Specifically, for example, an aggregating agent is added to the mixed dispersion, pH of the mixed dispersion is adjusted to be acidic (for example, pH of 2 to 5), and optionally a dispersion stabilizer is added thereto. Thereafter, the mixed dispersion is heated at a temperature lower than the glass transition temperature of the resin particles (specifically, for example, from a temperature 30° C. lower than the glass transition temperature of the resin particles to a temperature 10° C. lower than the glass transition temperature of the resin particles) to aggregate the particles dispersed in the mixed dispersion, thereby forming aggregated particles.

In the step of forming aggregated particles, for example, the above aggregating agent is added at room temperature (for example, 25° C.) while the mixed dispersion is being stirred with a rotating shear type homogenizer, pH of the mixed dispersion is adjusted to be acidic (for example, pH of 2 to 5), a dispersion stabilizer is optionally added thereto, and then heating may be performed as described above.

Examples of the aggregating agent include surfactants having a polarity opposite to that of surfactants used as the dispersant added to the mixed dispersion, such as an inorganic metal salt and a metal complex having a valency of 2 or higher. Particularly, when the metal complex is used as the aggregating agent, the amount of the surfactant used is reduced, and the charging characteristics are improved.

An additive that forms a complex or a bond similar to the complex with metal ions of the aggregating agent may be optionally used. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide; and the like.

As the chelating agent, a water-soluble chelating agent may be used. Examples of the chelating agent include oxycarboxylic acids such as tartaric acid, citric acid, and gluconic acid, iminodiacetic acid (IDA), nitrilotriacetic acid (NTA), ethylenediaminetetraacetic acid (EDTA), and the like.

The amount of the chelating agent added is, for example, in a range of 0.01 part by weight to 5.0 parts by weight, and may be in a range of 0.1 part by weight to 3.0 parts by weight, based on 100 parts by weight of the polyester resin particles as a binder resin.

Step of Coalescence

Subsequently, the aggregated particle dispersion in which the aggregated particles are dispersed is heated at, for example, a temperature equal to or higher than the glass transition temperature of the polyester resin particles as a binder resin (for example, a temperature equal to or higher than a temperature 10° C. to 30° C. higher than the glass transition temperature of the resin particles) so as to cause the aggregated particles to coalesce, thereby forming toner base particles.

Through the above steps, the toner base particles are obtained.

After the step of coalescence ends, the toner base particles formed in a solution go through known washing step, solid-liquid separation step, and drying step, thereby obtaining dry toner base particles.

In the washing step, it is preferable to sufficiently perform displacement washing by using deionized water, in view of charging properties. The solid-liquid separation step is not particularly limited, but in view of productivity, suction filtration, pressurizing filtration, and the like may be preferably used. The drying step is also not particularly limited, but in view of productivity, freeze drying, flash jet drying, fluidized drying, vibration type fluidized drying, and the like may be preferably used.

The toner base particles of the present exemplary embodiment are prepared by, for example, a wet method as described above. Accordingly, an ester group of the polyester resin easily moves to the interface between the resin and water during the process of making particles, and as a result, the concentration of the polyester resin on the particle surface becomes higher than the concentration of the polyester resin in the inside of the particles.

External Addition of External Additive

In the toner according to the present exemplary embodiment, at least the silica particles (sol-gel silica) described above are externally added to the toner base particles.

Examples of the method for externally adding the sol-gel silica or other additives include mixing methods using a known mixer such as a V-shaped blender, a Henschel mixer, or a Lödige mixer.

The amount of the added sol-gel silica based on 100 parts by weight of the toner base particles is preferably from 0.5 part by weight to 5.0 parts by weight, more preferably from 1.0 part by weight to 4.0 parts by weight, and even more preferably from 1.0 part by weight to 3.0 parts by weight.

In addition, additives other than the sol-gel silica may also be externally added, and examples of those other additives include a fluidizer, a cleaning aid such as polystyrene particles, polymethyl methacrylate particles, or polyvinylidene fluoride particles, a transfer aid, and the like.

Electrostatic Charge Image Developer

The electrostatic charge image developer according to the present exemplary embodiment contains at least the toner according to the present exemplary embodiment.

The electrostatic charge image developer according to the present exemplary embodiment may be a single-component developer including only the toner according to the present exemplary embodiment or may be a two-component developer obtained by mixing the toner with a carrier.

The carrier is not particularly limited, and examples thereof include known carriers such as a resin-coated carrier, a magnetic substance-dispersed carrier, a resin-dispersed carrier, and the like.

In the two-component developer, the mixing ratio (weight ratio) between the toner according to the present exemplary embodiment and the carrier is preferably in a range of about 1:100 to 30:100 (toner:carrier), and more preferably in a range of about 3:100 to 20:100.

Image Forming Apparatus and Image Forming Method

Next, the image forming apparatus and the image forming method according to the present exemplary embodiment that use the electrostatic charge image developing toner (electrostatic charge image developer) according to the present exemplary embodiment will be described.

The image forming apparatus according to the present exemplary embodiment includes an image holding member, a charging device that charges the image holding member, an electrostatic charge image forming device that forms an electrostatic charge image on a surface of a charged image holding member, a developing device that accommodates the electrostatic charge image developing toner according to the present exemplary embodiment and develops the electrostatic charge image formed on the image holding member as a toner image by using the electrostatic charge image developing toner, and a transfer device that transfers the toner image formed on the image holding member onto a transfer medium.

By the image forming apparatus according to the present exemplary embodiment, an image forming method including a step of charging the image holding member, a step of forming an electrostatic charge image on a surface of a charged image holding member, a step of developing the electrostatic charge image formed on the image holding member as a toner image by using the electrostatic charge image developing toner according to the present exemplary embodiment, and a step of transferring the toner image formed on the image holding member onto a transfer medium is performed.

When an electrophotographic photoreceptor is used as the image holding member, the image forming apparatus according to the present exemplary embodiment forms an image in the following manner for example. First, the surface of the electrophotographic photoreceptor is charged by a corotron charger, a contact charger, or the like, and then exposed to form an electrostatic charge image. Subsequently, the surface of the electrophotographic photoreceptor is bring into contact with or put close to a developing roller having a surface on which a developer layer has been formed, such that the toner is attached to the electrostatic latent image, thereby forming a toner image on the electrophotographic photoreceptor. The formed toner image is transferred onto the surface of a recording medium such as paper, by using a corotron charger or the like. In addition, the toner image transferred onto the surface of the recording medium is fixed by a fixing device, whereby an image is formed on the recording medium.

In the image forming apparatus according to the present exemplary embodiment, for example, a portion including a developing unit may have a cartridge structure (a toner cartridge, a process cartridge, or the like) that is detachable from the image forming apparatus.

As the toner cartridge, for example, a toner cartridge that accommodates the electrostatic charge image developing toner according to the present exemplary embodiment and is detachable from the image forming apparatus is suitably used.

As the process cartridge, for example, a process cartridge that accommodates the electrostatic charge image developer according to the present exemplary embodiment, includes a developing unit forming a toner image by developing the electrostatic latent image formed on the surface of the image holding member by using the electrostatic charge image developer, and is detachable from the image forming apparatus is suitably used.

An example of the image forming apparatus according to the present exemplary embodiment will be shown below, but the present invention is not limited thereto. Moreover, main portions shown in the drawing will be described, and other portions will not be described.

FIG. 1 is a schematic configurational view showing 4-drum tandem system color image forming apparatus. The image forming apparatus shown in FIG. 1 includes first to fourth electrophotographic image forming units 10Y, 10M, 10C, and 10K (image forming units) that output images of each color including yellow (Y), magenta (M), cyan (C), and black (K) based on image data separated for each color. These image forming units (hereinafter, simply called "units" in some cases) 10Y, 10M, 10C, and 10K are arranged in parallel while being separated from each other at preset intervals. The units 10Y, 10M, 10C, and 10K may be process cartridges attachable to and detachable from the body of the image forming apparatus.

Above the respective units 10Y, 10M, 10C, and 10K in the drawing, an intermediate transfer belt 20 extends as an intermediate transfer member through the units. The intermediate transfer belt 20 is wound around a driving roller 22 and a supporting roller 24 contacting the inner surface of the intermediate transfer belt 20, which are rollers positioned separately from each other from the left to right in the drawing, and drives in a direction heading to the fourth unit 10K from the first unit 10Y. A force is applied to the supporting roller 24 by a spring not shown in the drawing or the like in a direction separating from the driving roller 22, and a tension is applied to the intermediate transfer belt 20 wound around the both rollers. To the image holding member side of the intermediate transfer belt 20, an intermediate transfer member cleaning device 30 is provided facing the driving roller 22.

The toners of 4 colors including yellow, magenta, cyan, and black contained in toner cartridges 8Y, 8M, 8C, and 8K are respectively supplied to developing devices (developing units) 4Y, 4M, 4C, and 4K, of the respective units 10Y, 10M, 10C, and 10K.

The first to fourth units 10Y, 10M, 10C, and 10K described above have the same configuration. Therefore, herein, the first unit 10Y which is disposed at the upstream side in the driving direction of the intermediate transfer belt and forms yellow images will be representatively described. In addition, the same portion as that of the first unit 10Y is marked with reference signs indicating magenta (M), cyan (C), and black (K) instead of yellow (Y) so as not to describe the second to fourth units 10M, 10C, and 10K.

The first unit 10Y includes a photoreceptor 1Y working as an image holding member. Around the photoreceptor 1Y, a charging roller 2Y that charges the surface of the photoreceptor 1Y with a preset potential, an exposure device (electrostatic charge image forming unit) 3 that forms an electrostatic charge image by exposing the charged surface with a laser beam 3Y based on image signals separated for each color, a developing device (developing unit) 4Y that develops the electrostatic charge image by supplying a charged toner to the electrostatic charge image, a primary transfer roller 5Y (primary transfer unit) that transfers the developed toner image to the intermediate transfer belt 20, and a photoreceptor cleaning device (cleaning unit) 6Y that removes the residual toner on the surface of the photoreceptor 1Y after the primary transfer are arranged in order.

The primary transfer roller 5Y is disposed inside the intermediate transfer belt 20, at a position facing the photoreceptor 1Y. Each of the primary transfer rollers 5Y, 5M, 5C, and 5K is respectively connected to a bias power source (not shown in the drawing) applying primary transfer bias. Each bias power source is controlled by a control portion not shown in the drawing, thereby varying transfer bias applied to each of the primary transfer rollers.

Hereinafter, the operation of forming a yellow image in the first unit 10Y will be described. First, prior to this operation, the surface of the photoreceptor 1Y is charged by the charging roller 2Y with a potential of about −600 V to −800 V.

The photoreceptor 1Y is formed of laminated photosensitive layers on a conductive (volume resistivity at 20° C.: $1\times10^{-6}$ Ωcm or less) substrate. The photosensitive layers show high resistivity (resistivity approximately similar to that of the general resin) in general. However, the layers have a characteristic that when the layers are irradiated with the laser beam 3Y, the specific resistivity of the portion irradiated with the laser beam changes. Therefore, according to image data for yellow transmitted from the control portion not shown in the drawing, the laser beam 3Y is output to the surface of the charged photoreceptor 1Y via the exposure device 3. The laser beam 3Y is emitted to the photosensitive layer on the surface of the photoreceptor 1Y, and as a result, an electrostatic charge image of a yellow printing pattern is formed on the surface of the photoreceptor 1Y.

The electrostatic charge image is an image formed on the surface of the photoreceptor 1Y by charging, and is a so-called negative latent image which is formed in a manner in which the specific resistivity of the portion of the photosensitive layer irradiated with the laser beam 3Y is lowered, and electric charge charging the surface of the photoreceptor 1Y flows while the electric charge in the portion not irradiated with the laser beam 3Y remains.

The electrostatic charge image formed on the photoreceptor 1Y in this manner is rotated to a preset developing position according to driving of the photoreceptor 1Y. In the developing position, the electrostatic charge image on the photoreceptor 1Y is made into a visible image (developed image) by the developing device 4Y.

The electrostatic charge image developer according to the present exemplary embodiment that includes at least, for example, a yellow toner and a carrier is contained in the developing device 4Y. The yellow toner is stirred inside the developing device 4Y so as to be charged triboelectrically, and is held on a developer roller (developer holding member) while having electric charge of the same polarity (negative polarity) as the electric charge charging the photoreceptor 1Y. When the surface of the photoreceptor 1Y passes through the developing device 4Y, the yellow toner is electrostatically attached to the erased latent image portion on the surface of the photoreceptor 1Y, whereby the latent image is developed by the yellow toner. The photoreceptor 1Y where the yellow toner image has been formed drives subsequently at a preset speed, and the toner image developed on the photoreceptor 1Y is transported to a preset primary transfer position.

When the yellow toner image on the photoreceptor 1Y is transported to the primary transfer position, a primary transfer bias is applied to the primary transfer roller 5Y, and an electrostatic force heading to the primary transfer roller 5Y from the photoreceptor 1Y acts on the toner image, whereby the toner image on the photoreceptor 1Y is transferred to the intermediate transfer belt 20. The polarity of the transfer bias applied at this time is (+)polarity which is a reverse polarity of the (−)polarity of the toner. For example, the bias is controlled to about +10 μA in the first unit 10Y, by a control portion (not shown in the drawing).

Meanwhile, the residual toner on the photoreceptor 1Y is removed by the cleaning device 6Y and is collected.

The primary transfer bias applied to the primary transfer rollers 5M, 5C, and 5K of the second unit 10M and the subsequent units is also controlled in the same manner as the first unit.

In this manner, the intermediate transfer belt 20 to which the yellow image has been transferred through the first unit 10Y is sequentially transported through the second to fourth units 10M, 10C, and 10K, whereby the toner images of each color are superposed and transferred by multi layer transfer.

The intermediate transfer belt 20 to which the toner images of four colors have been transferred by multi layer transfer through the first to fourth units reaches a secondary transfer portion configured with the intermediate transfer belt 20, the supporting roller 24 contacting the inner surface of the intermediate transfer belt, and a secondary transfer roller (secondary transfer unit) 26 disposed at the image holding surface side of the intermediate transfer belt 20. Meanwhile, recording paper (transfer medium) P is supplied through a supply mechanism at a preset timing to the gap where the secondary transfer roller 26 comes into pressure contact with the intermediate transfer belt 20, and a secondary transfer bias is applied to the supporting roller 24. The polarity of the transfer bias applied at this time is (−)polarity which is the same polarity as the (−)polarity of the toner, and the electrostatic force heading to the recording paper P from the intermediate transfer belt 20 acts on the toner image, whereby the toner image on the intermediate transfer belt 20 is transferred onto the recording paper P. At this time, the secondary transfer bias is determined according to resistance detected by a resistance detection unit (not shown in the drawing) that detects the resistance of the secondary transfer portion, and is voltage-controlled.

Thereafter, the recording paper P is sent into a pressure contact portion (nip portion) of a pair of fixing rolls in a fixing device (roll-like fixing unit) 28 so as to heat the toner image, and the toner image on which colors overlap each other is melted and fixed onto the recording paper P.

Examples of the transfer medium to which the toner image is transferred include plain paper used for an electrophotographic copying machine, a printer, or the like, an OHP sheet, and the like. For example, coated paper obtained by coating the surface of plain paper with a resin or the like, art paper for printing, and the like are suitably used.

The recording paper P in which the color image has been fixed is transported toward a discharge portion, whereby a series of operations of forming a color image end.

The image forming apparatus exemplified above is configured such that the toner image is transferred to the recording paper P via the intermediate transfer belt 20. However, the present exemplary embodiment is not limited to such a configuration, and the image forming apparatus may be configured such that the toner image is directly transferred to the recording paper from the photoreceptor.

Process Cartridge and Toner Cartridge

Figure 2:
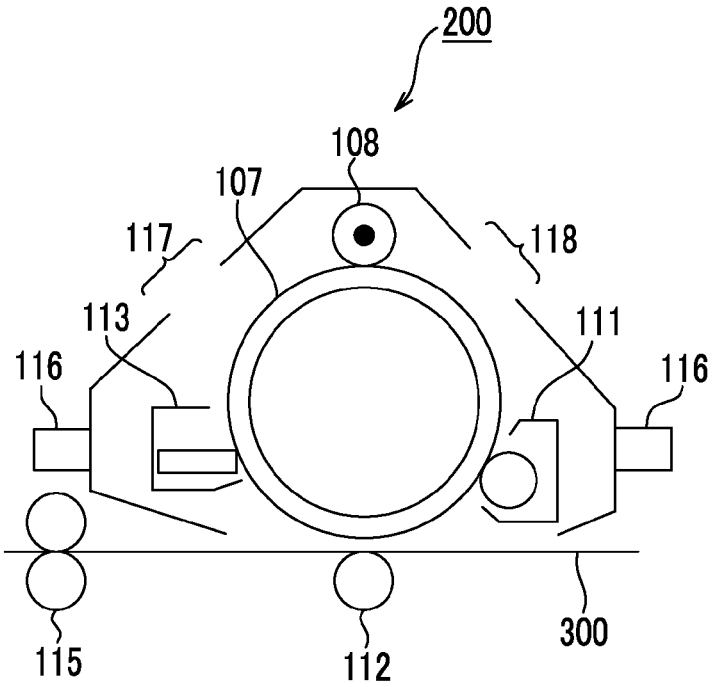
FIG. 2 is a schematic configurational view showing an example of the process cartridge according to the present exemplary embodiment.

FIG. 2 is a schematic configurational view showing a suitable example of an exemplary embodiment of a process cartridge containing the electrostatic charge image developer according to the present exemplary embodiment. A process cartridge 200 is formed by combining a photoreceptor 107 with a charging roller 108, a developing device 111, a photoreceptor cleaning device 113, an opening portion 118 for exposure, and an opening portion 117 for erasing exposure by using an assembly rail 116 and integrating these. In addition, in FIG. 2, the sign 300 indicates a transfer medium.

The process cartridge 200 is detachable from the image forming apparatus configured with a transfer device 112, a fixing device 115, and other configurational portions not shown in the drawing.

The process cartridge 200 shown in FIG. 2 includes the charging roller 108, the developing device 111, the cleaning device 113, the opening portion 118 for exposure, and the opening portion 117 for erasing exposure. However, these devices may be selectively combined. The process cartridge of the present exemplary embodiment may include at least one kind selected from a group consisting of the charging roller 108, the developing device 111, the cleaning device (cleaning unit) 113, the opening portion 118 for exposure, and the opening portion 117 for erasing exposure, in addition to the photoreceptor 107.

Next, the toner cartridge according to the present exemplary embodiment will be described. The toner cartridge according to the present exemplary embodiment is a toner cartridge that accommodates the electrostatic charge image developing toner and is detachable from the image forming apparatus.

The image forming apparatus shown in FIG. 1 is an image forming apparatus having a configuration in which toner cartridges 8Y, 8M, 8C, and 8K are detachable. The developing devices 4Y, 4M, 4C, and 4K are connected to the toner cartridges corresponding to the respective developing devices (colors) through toner supply tubes not shown in the drawing. When the toner accommodated in each toner cartridge is decreased, the toner cartridge is replaced.

EXAMPLES

Hereinafter, the present exemplary embodiment will be described in detail based on examples and comparative examples, but the present exemplary embodiment is not limited to the following examples. In addition, "part (s)" refers to "part (s) by weight" unless otherwise specified.

Toner Base Particles

Preparation of Resin

Preparation of Polyester Resin 1

| | |
|---|---|
| Polyoxyethylene (2,0)-2,2-bis(4-hydroxyphenyl)propane | 100 parts by mol |
| Terephthalic acid | 80 parts by mol |
| n-Dodecenyl succinate | 10 parts by mol |
| Isophthalic acid | 10 parts by mol |

The above components and dibutyltin oxide in an amount of 0.05 part by mol based on these acid components (total mol number of the terephthalic acid, n-dodecenyl succinsate, and isophthalic acid) are put in a flask dried by being heated, nitrogen gas is put into the container to maintain an inert atmosphere, and the temperature thereof is increased. Thereafter, copolycondensation is performed for 12 hours at a temperature of 150° C. to 230° C. Subsequently, the pressure is slowly reduced at a temperature of 210° C. to 250° C., thereby synthesizing a polyester resin 1.

Preparation of Vinyl Resin 2

| | |
|---|---|
| Styrene | 296 parts |
| n-Butyl acrylate | 104 parts |
| Acrylic acid | 6 parts |
| n-Dodecyl mercaptane | 10 parts |
| 2,2'-azobisisobutyronitrile | 0.8 part |

The above components are put in a flask dried by being heating and mixed with each other, and the mixture is subjected to nitrogen substitution and then polymerized at a temperature increased to 70° C., thereby obtaining a styrene-acrylic acid copolymer resin (vinyl resin 2).

Preparation of Resin Particle Dispersion 1

| | |
|---|---|
| Polyester resin 1 (PES) | 15 parts |
| Vinyl resin 2 (St/Ac) | 85 parts |

The above resins are dissolved in 167 parts of ethyl acetate, and 2.5 parts of an anionic surfactant (sodium dodecylbenzene sulfonate) and 250 parts of deioinzed water are added thereto, followed by heating at 60° C. The resultant is stirred at 8,000 rpm by using an emulsification machine (Ultra Turrax T-50, manufactured by IKA), and then ethyl acetate is evaporated, thereby preparing a resin particle dispersion 1 having a volume average particle size of 180 nm.

Preparation of Resin Particle Dispersion 2

| | |
|---|---|
| Polyester resin 1(PES) | 5 parts |
| Vinyl resin 2 (St/Ac) | 95 parts |

The above resins are dissolved in 167 parts of ethyl acetate, and 2.5 parts of an anionic surfactant (sodium dodecylbenzene sulfonate) and 250 parts of deioinzed water are added thereto, followed by heating at 60° C. The resultant is stirred at 8,000 rpm by using an emulsification machine (Ultra Turrax T-50, manufactured by IKA), and then ethyl acetate is evaporated, thereby preparing a resin particle dispersion 2 having a volume average particle size of 170 nm.

Preparation of resin particle dispersion 3

| | |
|---|---|
| Polyester resin 1 (PES) | 45 parts |
| Vinyl resin 2 (St/Ac) | 55 parts |

The above resins are dissolved in 167 parts of ethyl acetate, and 2.5 parts of an anionic surfactant (sodium dodecylbenzene sulfonate) and 250 parts of deioinzed water are added thereto, followed by heating at 60° C. The resultant is stirred at 8,000 rpm by using an emulsification machine (Ultra Turrax T-50, manufactured by IKA), and then ethyl acetate is evaporated, thereby preparing a resin particle dispersion 3 having a volume average particle size of 200 nm.

Preparation of Resin Particle Dispersion 4

| | |
|---|---|
| Polyester resin 1 (PES) | 100 parts |

The above resin is dissolved in 167 parts of ethyl acetate, and 2.5 parts of an anionic surfactant (sodium dodecylbenzene sulfonate) and 250 parts of deioinzed water are added thereto, followed by heating at 60° C. The resultant is stirred at 8,000 rpm by using an emulsification machine (Ultra Turrax T-50, manufactured by IKA), and then ethyl acetate is evaporated, thereby preparing a resin particle dispersion 4 having a volume average particle size of 190 nm.

Preparation of Resin Particle Dispersion 5

| | |
|---|---|
| Vinyl resin 2 (St/Ac) | 100 parts |

The above resin is dissolved in 167 parts of ethyl acetate, and 2.5 parts of an anionic surfactant (sodium dodecylbenzene sulfonate) and 250 parts of deioinzed water are added thereto, followed by heating at 60° C. The resultant is stirred at 8,000 rpm by using an emulsification machine (Ultra Turrax T-50, manufactured by IKA), and then ethyl acetate is evaporated, thereby preparing a resin particle dispersion 5 having a volume average particle size of 210 nm.

Preparation of Pigment Dispersion

| | |
|---|---|
| C. I. Pigment Blue 15:3 (phthalocyanine pigment: Cyanine blue 4937 manufactured by Dainichiseika Color & Chemicals Mfg, Co., Ltd.) | 50 parts |
| Anionic surfactant Neogen SC (manufactured by DAI-ICHI KOGYO SEIYAKU CO., LTD.) | 5 parts |
| Deionized water | 200 parts |

The above components are mixed and dissolved, and dispersed for 10 minutes using a homogenizer (Ultra Turrax manufactured by IKA), thereby obtaining a pigment dispersion having a median particle size of 175 nm.

Preparation of Release Agent Dispersion

| | |
|---|---|
| Paraffin wax (manufactured by NIPPON SEIRO CO., LTD.: HNP-9) | 25 parts |
| Anionic surfactant Neogen SC (manufactured by DAI-ICHI KOGYO SEIYAKU CO. , LTD.) | 5 parts |
| Deionized water | 200 parts |

The above components are heated at 95° C. and dispersed by using Ultra turrax T50 manufactured by IKA. Thereafter, the resultant is subjected to dispersion treatment using a pressure discharge type Gaulin homogenizer, thereby obtaining a release agent dispersion having a median particle size of 200 nm.

Preparation of Toner Base Particles

Preparation of Toner Base Particles 1

| | |
|---|---|
| Resin particle dispersion 1 | 500 parts |
| Pigment dispersion | 100 parts |
| Release agent dispersion | 200 parts |
| 10% by weight of aqueous polyaluminum chloride solution (manufactured by Asada Chemical Industry Co., Ltd.) | 0.8 part |
| 10% by weight of aqueous ammonium sulfate solution (manufactured by Asada Chemical Industry Co., Ltd.) | 1.0 part |
| 10% by weight of aqueous aluminum sulfate solution (manufactured by Asada Chemical Industry Co., Ltd.) | 1.2 parts |

The above components are mixed and dispersed in a round stainless steel flask by using a homogenizer (manufactured by IKA, Ultra turrax T50). Thereafter, the content in the flask is heated up to 45° C. under stirring and hold at 45° C. for 30 minutes.

When the obtained content is observed with an optical microscope, generation of aggregated particles is confirmed. pH thereof is adjusted to 8 by adding an aqueous sodium hydroxide solution to the content, and then the temperature is increased to 90° C. Thereafter, the aggregates are allowed to coalesce over 1 hour and cooled, followed by filtration, and sufficiently washed with deioinized water. Thereafter, the resultant is dried, thereby obtaining toner base particles 1. The average particle size thereof measured by the method described above is 5.8 μm, and a shape factor is 140.

For the toner base particles 1, the concentration of the polyester resin on the surface and the concentration of the polyester resin in the inside of the particles are investigated by the method described above. As a result, it is found that the concentration on the surface is higher.

Preparation of Toner Base Particles 2

| | |
|---|---|
| Resin particle dispersion 2 | 500 parts |
| Pigment dispersion | 100 parts |
| Release agent dispersion | 200 parts |
| 10% by weight of aqueous polyaluminum chloride solution (manufactured by Asada Chemical Industry Co., Ltd.) | 3.0 parts |
| 10% by weight of aqueous ammonium sulfate solution (manufactured by Asada Chemical Industry Co., Ltd.) | 1.0 part |

The above components are mixed and dispersed in a round stainless steel flask by using a homogenizer (manufactured by IKA, Ultra turrax T50). Thereafter, the content in the flask is heated up to 35° C. under stirring and hold at 35° C. for 30 minutes.

When the obtained content is observed with an optical microscope, generation of aggregated particles is confirmed. pH thereof is adjusted to 8 by adding an aqueous sodium hydroxide solution to the content, and then the temperature is increased to 85° C. Thereafter, the aggregates are allowed to coalesce over 1 hour and cooled, followed by filtration, and sufficiently washed with deioinized water. Thereafter, the resultant is dried, thereby obtaining toner base particles 2. The average particle size thereof measured by the method described above is 3.2 μm, and a shape factor is 155.

For the toner base particles 2, the concentration of the polyester resin on the surface and the concentration of the polyester resin in the inside of the particles are investigated by the method described above. As a result, it is found that the concentration on the surface is higher.

Preparation of Toner Base Particles 3

| | |
|---|---|
| Resin particle dispersion 3 | 500 parts |
| Pigment dispersion | 100 parts |
| Release agent dispersion | 200 parts |
| 10% by weight of aqueous polyaluminum chloride solution (manufactured by Asada Chemical Industry Co., Ltd.) | 4.0 parts |

The above components are mixed and dispersed in a round stainless steel flask by using a homogenizer (manufactured by IKA, Ultra turrax T50). Thereafter, the content in the flask is heated up to 55° C. under stirring and hold at 55° C. for 30 minutes.

When the obtained content is observed with an optical microscope, generation of aggregated particles is confirmed. pH thereof is adjusted to 8 by adding an aqueous sodium hydroxide solution to the content, and then the temperature is increased to 95° C. Thereafter, the aggregates are allowed to coalesce over 1 hour and cooled, followed by filtration, and sufficiently washed with deioinized water. Thereafter, the resultant is dried, thereby obtaining toner base particles 3. The average particle size thereof measured by the method described above is 7.5 μm, and a shape factor is 130.

For the toner base particles 3, the concentration of the polyester resin on the surface and the concentration of the polyester resin in the inside of the particles are investigated by the method described above. As a result, it is found that the concentration on the surface is higher.

Preparation of Toner Base Particles 4

| | |
|---|---|
| Resin particle dispersion 4 | 500 parts |
| Pigment dispersion | 100 parts |
| Release agent dispersion | 200 parts |

-continued

| | |
|---|---|
| 10% by weight of aqueous polyaluminum chloride solution (manufactured by Asada Chemical Industry Co., Ltd. ) | 4.0 parts |

The above components are mixed and dispersed in a round stainless steel flask by using a homogenizer (manufactured by IKA, Ultra turrax T50). Thereafter, the content in the flask is heated up to 48° C. under stirring and hold at 48° C. for 30 minutes.

When the obtained content is observed with an optical microscope, generation of aggregated particles is confirmed. pH thereof is adjusted to 8 by adding an aqueous sodium hydroxide solution to the content, and then the temperature is increased to 90° C. Thereafter, the aggregates are allowed to coalesce over 1 hour and cooled, followed by filtration, and sufficiently washed with deioinized water. Thereafter, the resultant is dried, thereby obtaining toner base particles 4. The average particle size thereof measured by the method described above is 5.5 μm, and a shape factor is 135.

Preparation of Toner Base Particles 5

| | |
|---|---|
| Resin particle dispersion 5 | 500 parts |
| Pigment dispersion | 100 parts |
| Release agent dispersion | 200 parts |
| 10% by weight of aqueous polyaluminum chloride solution (manufactured by Asada Chemical Industry Co, Ltd.) | 4.0 parts |

The above components are mixed and dispersed in a round stainless steel flask by using a homogenizer (manufactured by IKA, Ultra turrax T50). Thereafter, the content in the flask is heated up to 47° C. under stirring and hold at 47° C. for 30 minutes.

When the obtained content is observed with an optical microscope, generation of aggregated particles is confirmed. pH thereof is adjusted to 8 by adding an aqueous sodium hydroxide solution to the content, and then the temperature is increased to 90° C. Thereafter, the aggregates are allowed to coalesce over 1 hour and cooled, followed by filtration, and sufficiently washed with deioinized water. Thereafter, the resultant is dried, thereby obtaining toner base particles 5. The average particle size thereof measured by the method described above is 5.9 μm, and a shape factor is 139.

Example 1

Sol-Gel Silica

Preparation Step: Preparation of Alkaline Catalyst Solution (1)

200 parts of methanol and 36 parts of 10% by weight aqueous ammonia are put in a reaction container made of glass that includes a stirring blade, a dropping nozzle, and a thermometer, followed by mixing under stirring, thereby obtaining an alkaline catalyst solution (1). The amount of the ammonia catalyst of the alkaline catalyst solution (1): amount of $NH_3$ ($NH_3$[mol]/($NH_3$+methanol+water) [L]) is 0.73 mol/L.

Step of Generating Particles: Preparation of Silica Particle Suspension (1)

First Supply Step

Subsequently, the temperature of the alkaline catalyst solution (1) is adjusted to 30° C., and the alkaline catalyst solution (1) is purged with nitrogen. Thereafter, while the alkaline catalyst solution (1) is being stirred at 120 rpm, tetramethoxysilane (TMOS) and aqueous ammonia having a catalyst ($NH_3$) concentration of 3.7% are added dropwise thereto at flow rates of 4 parts/min and 2.4 parts/min respectively so as to start the supply of the tetramethoxysilane and the aqueous ammonia simultaneously.

At a point in time when 1.5 min has elapsed from the beginning of the supply of the tetramethoxysilane and the aqueous ammonia, the supply of the tetramethoxysilane and the aqueous ammonia is stopped simultaneously. At a point in time when the supply of the tetraalkoxysilane and the aqueous ammonia is stopped, the amount of the supplied tetramethoxysilane is 0.0063 mol/mol based on the amount of the alcohol added to the reaction container in the preparation step.

Maturation Step

The supply of the tetramethoxysilane and the aqueous ammonia is stopped for 1.5 min.

Second Supply Step 1.5 min after stopping of the supply of the tetramethoxysilane and the aqueous ammonia, the supply of the tetramethoxysilane and the aqueous ammonia is resumed. For the supply, the flow rates of the tetramethoxysilane and the aqueous ammonia are adjusted to 4 parts/min and 2.4 parts/min respectively, and the tetramethoxysilane and the aqueous ammonia are supplied dropwise.

The total amount of the tetramethoxysilane and the 3.7% by weight of the aqueous ammonia added in the entire steps including the first and second supply steps is set to 30 parts for the tetramethoxysilane and 18 parts for the 3.7% by weight aqueous ammonia.

After 30 parts of the tetramethoxysilane and 18 parts of the 3.7% by weight of the aqueous ammonia are added dropwise, a hydrophilic silica particle suspension (1) is obtained.

Hydrophobizing Treatment

Subsequently, hydrophobizing treatment is performed on the hydrophilic silica particles by the following method. During the hydrophobizing treatment, a device that includes a carbon dioxide cylinder, a carbon dioxide pump, an autoclave including a stirrer, and a back pressure valve is used.

First, 20.0 parts of powder of the obtained hydrophilic silica particles are put into the autoclave, and then 6 parts of hexamethyldisilazane (manufactured by Wako Pure Chemical Industries) is put into the autoclave. Thereafter, the autoclave is filled with liquefied carbon dioxide and the temperature thereof is raised up to 170° C. by a heater. Subsequently, the pressure thereof is increased up to 20 MPa by using the carbon dioxide pump. The stirrer is driven at 200 rpm and hold as is for 30 minutes. After the hydrophobizing treatment, the back pressure valve is opened until the pressure becomes atmospheric pressure, and the autoclave is cooled to room temperature (25° C.). Thereafter, the stirrer is stopped, and powder of hydrophobic sol-gel silica particles having undergone the hydrophobizing treatment is taken out of the autoclave.

Preparation of Toner

The toner base particles 1 and the hydrophobic sol-gel silica particles are mixed and blended with each other for 3 minutes at 1300 rpm by using Henschel mixer, under such a condition that the amount of the hydrophobic sol-gel silica particles is 1.5 parts by weight based on 100 parts by weight of the toner base particles 1. Thereafter, the resultant is sieved with a sieve having an aperture size of 45 μm, thereby preparing the respective toners.

Preparation of Carrier

| | |
|---|---|
| Ferrite particles (volume average particle size: 35 μm) | 100 parts |
| Toluene | 14 parts |

-continued

| | |
|---|---|
| Perfluoroacrylate copolymer (critical surface tension: 24 dyn/cm) | 1.6 parts |
| Carbon black (trade name: VXC-72, manufactured by Cabot Corporation, volume resistivity: 100 Ωcm or less) | 0.12 parts |
| Crosslinked melamine resin particles (average particle size: 0.3 μm, insoluble in toluene) | 0.3 part |

First, carbon black diluted with toluene is added to the perfluoroacrylate copolymer, and the resultant is dispersed using a sand mill. Subsequently, the above respective components other than ferrite particles are dispersed in the resultant for 10 minutes by using a stirrer, thereby preparing a liquid for forming a coating layer. Thereafter, the liquid for forming a coating layer and the ferrite particles are put in a vacuum deaeration type kneader and stirred for 30 minutes at 60° C. Then toluene is evaporated under reduced pressure to form a resin-coating layer, thereby obtaining a carrier.

Preparation of Developer 36 parts by weight of the obtained toner and 414 parts by weight of the carrier are put in a 2 L V-blender, followed by stirring for 20 minutes. Thereafter, the resultant is sieved using a sieve of 212 μm, thereby preparing a developer.

Example 2

A developer is prepared by the same method as described in Example 1, except that in preparing sol-gel silica, the total amounts of the tetramethoxysilane and the 3.7% by weight aqueous ammonia added in the entire steps including the first and second supply steps are changed to 40 parts for the tetramethoxysilane and 24 parts for the 3.7% by weight aqueous ammonia.

Example 3

A developer is prepared by the same method as described in Example 1, except that in preparing sol-gel silica, the total amounts of the tetramethoxysilane and the 3.7% by weight aqueous ammonia added in the entire steps including the first and second supply steps are changed to 60 parts for the tetramethoxysilane and 36 parts for the 3.7% by weight aqueous ammonia.

Example 4

A developer is prepared by the same method as described in Example 1, except that in preparing sol-gel silica, the total amounts of the tetramethoxysilane and the 3.7% by weight aqueous ammonia added in the entire steps including the first and second supply steps are changed to 75 parts for the tetramethoxysilane and 45 parts for the 3.7% by weight aqueous ammonia.

Example 5

A developer is prepared by the same method as described in Example 1, except that in preparing sol-gel silica, the total amounts of the tetramethoxysilane and the 3.7% by weight aqueous ammonia added in the entire steps including the first and second supply steps are changed to 100 parts for the tetramethoxysilane and 60 parts for the 3.7% by weight aqueous ammonia.

Example 6

A developer is prepared by the same method as described in Example 1, except that in preparing sol-gel silica, the total amounts of the tetramethoxysilane and the 3.7% by weight aqueous ammonia added in the entire steps including the first and second supply steps are changed to 25 parts for the tetramethoxysilane and 15 parts for the 3.7% by weight aqueous ammonia.

Example 7

A developer is prepared by the same method as described in Example 1, except that in preparing sol-gel silica, the total amounts of the tetramethoxysilane and the 3.7% by weight aqueous ammonia added in the entire steps including the first and second supply steps are changed to 110 parts for the tetramethoxysilane and 66 parts for the 3.7% by weight aqueous ammonia.

Example 8

A developer is prepared by the same method as described in Example 3, except that in preparing sol-gel silica, the time for stopping the supply of the tetramethoxysilane and aqueous ammonia in the maturation step is changed to 2.0 min.

Example 9

A developer is prepared by the same method as described in Example 3, except that in preparing sol-gel silica, the time for stopping the supply of the tetramethoxysilane and aqueous ammonia in the maturation step is changed to 0.5 min.

Example 10

A developer is prepared by the same method as described in Example 3, except that in preparing sol-gel silica, the time for stopping the supply of the tetramethoxysilane and aqueous ammonia in the maturation step is changed to 0.2 min.

Example 11

A developer is prepared by the same method as described in Example 3, except that in preparing sol-gel silica, the time for stopping the supply of the tetramethoxysilane and aqueous ammonia in the maturation step is changed to 0.1 min.

Example 12

A developer is prepared by the same method as described in Example 3, except that in preparing sol-gel silica, the tetramethoxysilane and aqueous ammonia are simultaneously stopped to be supplied, at a point in time when 0.7 min has elapsed from the beginning of the supply of the tetramethoxysilane and aqueous ammonia in the first supply step.

Example 13

A developer is prepared by the same method as described in Example 3, except that in preparing sol-gel silica, the tetramethoxysilane and aqueous ammonia are simultaneously stopped to be supplied, at a point in time when 2.5 min has elapsed from the beginning of the supply of the tetramethoxysilane and aqueous ammonia in the first supply step.

Example 14

A developer is prepared by the same method as described in Example 3, except that the method of the hydrophobizing treatment is changed to the following mixing method using a mixer.

Mixing Using Mixer 100 parts of powder of the obtained hydrophilic silica particles are put in a mixer and stirred at 200 rpm under heating at 200° C. in a nitrogen atmosphere. Thereafter, hexamethyldisilazane (HMDS) is added dropwise thereto in an amount of 30 parts based on the powder of the hydrophilic silica particles and reacted for 2 hours. Subsequently, the resultant is cooled and subjected to hydrophobizing treatment, thereby obtaining powder of hydrophobic silica particles.

Example 15

A developer is prepared by the same method as described in Example 3, except that in preparing a toner, the toner base particles 1 are changed to the toner base particles 2.

Example 16

A developer is prepared by the same method as described in Example 3, except that in preparing a toner, the toner base particles 1 are changed to the toner base particles 3.

Comparative Example 1

A developer is prepared by the same method as described in Example 3, except that in preparing a toner, the toner base particles 1 are changed to the toner base particles 4.

Comparative Example 2

A developer is prepared by the same method as described in Example 3, except that in preparing a toner, the toner base particles 1 are changed to the toner base particles 5.

Comparative Example 3

A developer is prepared by the same method as described in Example 3, except that in preparing sol-gel silica, the time for stopping the supply of the tetramethoxysilane and aqueous ammonia in the maturation step is changed to 3.5 min.

Comparative Example 4

A developer is prepared by the same method as described in Example 3, except that in preparing sol-gel silica, the time for stopping the supply of the tetramethoxysilane and aqueous ammonia in the maturation step is changed to 0.15 min.

EVALUATION

Evaluation for Embedment

A state where the sol-gel silica is embedded into the toner base particles is observed by the following method. In an environment of a temperature of 28° C. and a humidity of 80% RH, the toner is filled in a developing unit of a modified machine of DocuCentreColor a450 (manufactured by Fuji Xerox Co., Ltd) (which is modified such that the process speed and the temperature of a fixing unit are controlled by an external power controller). The process speed is set to 450 mm/sec, the fixing temperature is set to 150° C., and the machine is operated to performing printing on 30,000 sheets. By using a scanning electron microscope (SEM), the state of particles added onto the surface of the toner particles is observed as the state before and after the operation of the machine, thereby performing relative sensory evaluation.

A: Embedment does not occur at all.

B: Though embedded into the toner particles, the sol-gel silica is present on the toner surface.

C: The sol-gel silica is embedded into the toner base particles and is not present on the toner surface.

Test for Hygroscopicity

A state where the toner base particles absorb moisture is tested by the following method.

A difference between the moisture content of the toner base particles having been left for 24 hours in an environment of a temperature of 28° C. and a humidity of 85% and the moisture content of the toner base particles having been left for 24 hours in an environment of a temperature of 20° C. and a humidity of 55% is taken as a hygroscopic degree. Moreover, the moisture content is measured in the following manner. By using a thermobalance, the toner base particles are heated up to 150° C. from room temperature (25° C.) at a temperature increase rate of 3° C./min and hold at 150° C. for 30 minutes. From the weight thereof reduced by heating, the moisture content is obtained.

A: 0% or more and less than 0.5%

B: 0.5% or more and less than 1.5%

C: 1.5% or more and less than 3.0%

D: 3.0% or more

Evaluation for Transfer Maintainability

The transfer property of the toner is observed by the following test.

In an environment of a temperature of 28° C. and a humidity of 80% RH, the toner is filled in a developing unit of a modified machine of DocuCentreColor a450 (manufactured by Fuji Xerox Co., Ltd) (which is modified such that the process speed and the temperature of a fixing unit are controlled by an external power controller). The process speed is set to 450 mm/sec, the fixing temperature is set to 150° C. Under this condition, a solid batch of 5 cm×2 cm is developed using A4 paper (J paper) manufactured by Fuji Xerox Co., Ltd., the developed toner image on the photoreceptor surface is collected by utilizing adhesiveness of the surface of an adhesive tape, and the weight (W1) of the image is measured.

Thereafter, the same developed toner image is transferred to the surface of paper (J paper), and the weight (W2) of the transferred image is measured. From these results, a transfer efficiency A is obtained by the following formula.

Subsequently, 20,000 sheets of white solid images are output, a transfer efficiency B(%) is then obtained in the same manner, and a value obtained from [transfer efficiency A(%)−transfer efficiency B(%)] is taken as transfer maintainability. From the value of the transfer maintainability, transfer maintainability is evaluated according to the following evaluation criteria. In addition, Comparative examples 2 and 3 do not tolerate the operation of the machine, so these fail to be evaluated.

$$\text{Transfer efficiency}(\%)=(W2/W1)\times 100$$

A: 0% or more and less than 2%

B: 2% or more and less than 5%

C: 5% or more and less than 10%

D: 10% or more

TABLE 1

| | Toner base particles | | | | | | | Silica | | | |
|---|---|---|---|---|---|---|---|---|---|---|---|
| | Toner base particles | Type of resin | Added amount [part(s)] | Type of resin | Added amount [part(s)] | Average particle size [μm] | SF1 | Average particle size [μm] | Average circularity | Da/H | Treatment for silica |
| Example 1 | 1 | PES | 15 | St/Ac | 85 | 5.8 | 140 | 72 | 0.81 | 1.71 | Supercritical |
| Example 2 | 1 | PES | 15 | St/Ac | 85 | 5.8 | 140 | 90 | 0.82 | 1.70 | Supercritical |
| Example 3 | 1 | PES | 15 | St/Ac | 85 | 5.8 | 140 | 127 | 0.80 | 1.69 | Supercritical |
| Example 4 | 1 | PES | 15 | St/Ac | 85 | 5.8 | 140 | 154 | 0.81 | 1.72 | Supercritical |
| Example 5 | 1 | PES | 15 | St/Ac | 85 | 5.8 | 140 | 198 | 0.81 | 1.70 | Supercritical |
| Example 6 | 1 | PES | 15 | St/Ac | 85 | 5.8 | 140 | 63 | 0.80 | 1.68 | Supercritical |
| Example 7 | 1 | PES | 15 | St/Ac | 85 | 5.8 | 140 | 218 | 0.82 | 1.70 | Supercritical |
| Example 8 | 1 | PES | 15 | St/Ac | 85 | 5.8 | 140 | 129 | 0.76 | 1.71 | Supercritical |
| Example 9 | 1 | PES | 15 | St/Ac | 85 | 5.8 | 140 | 131 | 0.78 | 1.68 | Supercritical |
| Example 10 | 1 | PES | 15 | St/Ac | 85 | 5.8 | 140 | 125 | 0.86 | 1.72 | Supercritical |
| Example 11 | 1 | PES | 15 | St/Ac | 85 | 5.8 | 140 | 129 | 0.89 | 1.69 | Supercritical |
| Example 12 | 1 | PES | 15 | St/Ac | 85 | 5.8 | 140 | 127 | 0.80 | 1.41 | Supercritical |
| Example 13 | 1 | PES | 15 | St/Ac | 85 | 5.8 | 140 | 132 | 0.82 | 2.07 | Supercritical |
| Example 14 | 1 | PES | 15 | St/Ac | 85 | 5.8 | 140 | 125 | 0.81 | 1.71 | Mixer |
| Example 15 | 2 | PES | 5 | St/Ac | 95 | 3.2 | 155 | 127 | 0.80 | 1.69 | Supercritical |
| Example 16 | 3 | PES | 45 | St/Ac | 55 | 7.5 | 130 | 127 | 0.80 | 1.69 | Supercritical |
| Comparative example 1 | 4 | PES | 100 | St/Ac | 0 | 5.5 | 135 | 127 | 0.80 | 1.69 | Supercritical |
| Comparative example 2 | 5 | PES | 0 | St/Ac | 100 | 5.9 | 139 | 127 | 0.81 | 1.71 | Supercritical |
| Comparative example 3 | 1 | PES | 15 | St/Ac | 85 | 5.8 | 140 | 132 | 0.73 | 1.68 | Supercritical |
| Comparative example 4 | 1 | PES | 15 | St/Ac | 85 | 5.8 | 140 | 125 | 0.91 | 1.70 | Supercritical |

TABLE 2

| | Evaluation | | |
|---|---|---|---|
| | Embedment | Hygroscopicity | Transfer maintainability |
| Example 1 | C | A | C |
| Example 2 | B | A | B |
| Example 3 | A | A | A |
| Example 4 | B | A | B |
| Example 5 | C | A | C |
| Example 6 | C | A | C |

TABLE 2-continued

| | Evaluation | | |
|---|---|---|---|
| | Embedment | Hygroscopicity | Transfer maintainability |
| Example 7 | C | A | C |
| Example 8 | B | A | B |
| Example 9 | B | A | B |
| Example 10 | A | B | B |
| Example 11 | A | C | C |
| Example 12 | A | C | C |
| Example 13 | C | A | C |
| Example 14 | A | A | A |
| Example 15 | B | A | B |
| Example 16 | B | C | C |
| Comparative example 1 | B | D | D |
| Comparative example 2 | | Unevaluable | |
| Comparative example 3 | | Unevaluable | |
| Comparative example 4 | A | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner base particles which contain a polyester resin and a vinyl resin and does not have a coating layer and wherein the concentration of the polyester resin on the particle surface is higher than the concentration of the polyester resin in the inside of the particles; and a sol-gel silica which has an average circularity of from 0.75 to 0.9, on the surface of the toner base particles, wherein an average of a ratio of a circle-equivalent diameter (Da) of the sol-gel silica that is obtained by planer image analysis to a maximum height (H) of the sol-gel silica that is obtained by three-dimensional image analysis is from 1.5 to 1.9.

2. The electrostatic charge image developing toner according to claim 1, wherein a volume average particle size of the sol-gel silica is from 70 nm to 200 nm.

3. An electrostatic charge image developer comprising at least the electrostatic charge image developing toner according to claim 1.

4. A toner cartridge that accommodates the electrostatic charge image developing toner according to claim 1 and is detachable from an image forming apparatus.

5. A developing device comprising a developing member that accommodates the electrostatic charge image developing toner according to claim 1 and develops an electrostatic charge image formed on an image holding member as a toner image by using the electrostatic charge image developing toner.

6. An image forming apparatus comprising:

an image holding member;

a charging device that charges the image holding member;

an electrostatic charge image forming device that forms an electrostatic charge image on a surface of a charged image holding member;

a developing device that accommodates the electrostatic charge image developing toner according to claim 1 and develops the electrostatic charge image formed on the image holding member as a toner image by using the electrostatic charge image developing toner; and a transfer device that transfers the toner image formed on the image holding member to a transfer medium.

7. An image forming method comprising:

charging an image holding member;

forming an electrostatic charge image on a surface of a charged image holding member;

developing the electrostatic charge image formed on the image holding member as a toner image by using the electrostatic charge image developing toner according to claim 1; and transferring the toner image formed on the image holding member to a transfer medium.

* * * * *